US007359665B2

(12) United States Patent
Onodera

(10) Patent No.: US 7,359,665 B2
(45) Date of Patent: Apr. 15, 2008

(54) IMAGE FORMING APPARATUS HAVING FIXING DEVICE WITH ENDLESS FIXING BELT

(75) Inventor: Masahiro Onodera, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 181 days.

(21) Appl. No.: 11/284,926

(22) Filed: Nov. 23, 2005

(65) Prior Publication Data

US 2006/0165447 A1 Jul. 27, 2006

(30) Foreign Application Priority Data

Jan. 27, 2005 (JP) ..... 2005-019644

(51) Int. Cl.
*G03G 15/20* (2006.01)

(52) U.S. Cl. ..... 399/329; 399/45; 399/67

(58) Field of Classification Search ..... 399/45, 399/67, 68, 320, 328, 329; 219/216
See application file for complete search history.

(56) References Cited

U.S. PATENT DOCUMENTS

2004/0042809 A1* 3/2004 Fuma et al. ..... 399/67

FOREIGN PATENT DOCUMENTS

| | | |
|---|---|---|
| JP | 2003-005566 | 1/2003 |
| JP | 2003-122172 | 4/2003 |
| JP | 2003-330309 | 11/2003 |
| JP | 2003-330310 | 11/2003 |

* cited by examiner

*Primary Examiner*—Hoang Ngo
(74) *Attorney, Agent, or Firm*—Finnegan, Henderson, Farabow, Garrett & Dunner, L.L.P.

(57) ABSTRACT

An image forming apparatus including: an image forming section to form a toner image on a recording sheet; a fixing device which has a fixing roller, an endless fixing belt trained with a tension about at least two rollers including the fixing roller, a heating device to heat the endless fixing belt, and a pressure roller to press the fixing roller through the endless belt, wherein the fixing device fixes the toner image on the recording sheet at a nip portion formed between the heated endless fixing belt and the pressure roller; a tension changing section to change the tension of the endless fixing belt; a recording sheet discriminating section to discriminate a type of recording sheet to be used; and a controller controling to make the tension changing section to change the tension of the fixing belt corresponding to the type of recording sheet.

3 Claims, 3 Drawing Sheets

IMAGE FORMING APPARATUS HAVING FIXING DEVICE WITH ENDLESS FIXING BELT

This application is based on Japanese Patent Application No. 2005-019644 filed with Japan Patent Office on Jan. 27, 2005.

BACKGROUND OF THE INVENTION

1. Field of the Invention

The present invention relates to an image forming apparatus equipped with a belt fixing device that fixes unfixed toner on a recording sheet through heating and applying pressure, and in particular, to an image forming apparatus wherein a separation performance of a recording sheet after having passed through a nip portion of the belt fixing device is improved.

2. Background of the Invention

In image forming apparatuses of an electrophotographic system such as a copying machine, a printer, a facsimile machine and a multifunctional machine equipped with various functions of the aforesaid equipment, a latent image corresponding to a document is formed on a photoconductor, and the latent image is given toner to be visualized, and a visualized toner image is transferred onto a recording paper, and then, the toner image transferred onto the recording paper is fixed and then, is ejected.

Further, when forming a color image, latent images respectively for Y, M, C and K are formed respectively on four photoconductor drums, and after transferring primarily visualized toner images respectively for four colors onto an intermediate transfer member composed of an endless belt, a toner image is transferred secondarily on the recording paper, and the toner image thus transferred onto the recording paper is fixed, and ejected.

AS a fixing device for fixing a toner image, there is available a heat roller fixing device wherein the recording paper onto which a toner image is transferred is heated and pressed in a nip portion formed by a heat roller having therein a halogen heater and a pressure roller that presses the heat roller, while the recording paper is interposed between the heat roller and the pressure roller to be conveyed, and the fixing device of this kind is widely used because of its simple structure.

There is further available a fixing device of a belt fixing type wherein an endless fixing belt is trained about a heat roller having therein a halogen heater and about a fixing roller, a pressure roller that presses the fixing roller through the fixing belt is provided, and the recording paper onto which a toner image has been transferred is heated and pressed in a nip portion formed by the fixing belt and the pressure roller while the recording paper is interposed between the fixing belt and the pressure roller to be conveyed. The fixing device of this kind has advantages that the time required for a warm-up is shortened because heat capacities of the fixing belt and the heat roller are small, which results in energy saving.

In the fixing device, however, toner of a toner image on the recording paper is heated when the recording paper passes through the nip portion, and the toner acts as adhesives, thus, the recording sheet that has passed through the nip portion is not separated to be wound round the fixing belt while sticking to the surface of the fixing belt, resulting in a fear of occurrence of a jam. When a sheet of paper having light weight (thin paper) is used, especially when coated paper for printing having light weight is used, in particular, separation performance is further reduced.

Further, in the case of a full-color image forming apparatus, it is desirable that images are glossy, and for this reason, it is considered that a nip width is broadened to make the heating time to be longer. For broadening the nip width, a rubber layer of the fixing roller may be thickened, or a diameter of the fixing roller may be made greater.

When using a heat roller fixing device, it is difficult to thicken the rubber layer having a low coefficient of thermal conductivity, because the fixing roller has therein a heat source such as a halogen heater. In addition, if a diameter of the fixing roller is made to be greater, separation performance of recording paper is lowered.

On the other hand, in the belt fixing device, the rubber layer can be thickened because the fixing roller has no heat source, and it is possible to broaden the nip width even when a diameter of the fixing roller is small. Therefore, the belt fixing device is more advantageous than the heat roller fixing device on the point of separation functions of recording paper.

In the case of a high-speed apparatus in particular, the belt fixing device in which a rubber layer can be thickened is advantageous.

However, it is still difficult to separate completely the recording paper having passed through the nip portion, even when the belt fixing device is used.

Accordingly, there is available a fixing device wherein a separation claw is arranged to be in contact with a fixing belt at the downstream side in the conveyance direction of recording paper in the fixing device, so that the recording paper may be separated from the fixing belt. In this structure, however, there is a fear that the fixing belt is worn away to be deteriorated, because the separation claw is constantly in contact with the fixing belt.

There are further disclosed many Patent Documents aiming an improvement of separation functions of recording paper in a fixing device.

For example, there is a belt fixing device wherein a fixing belt is trained about a heat roller, a fixing roller and a fixed member having a small radius of curvature, and the fixed member is in pressure contact with a pressure roller through the fixing belt from the inside of the fixing belt. In this fixing device, separation functions of recording paper are improved without providing a separation claw, because a radius of curvature of the fixing belt is made to be smaller by the fixed member having a small radius of curvature (see Patent Document 1).

There is further a belt fixing device wherein a plurality of separation rotors each having plural claws on its circumference and being driven to rotate are provided at an exit side of a nip portion, and recording paper is separated by the separation rotor from a surface of a fixing belt (see Patent Document 2).

There is still further a belt fixing device wherein a separation member composed of a stainless steel plate is arranged at an exit side of a nip portion on a non-contact with a fixing belt basis, and the separation member prevents recording paper from winding round the fixing belt(see Patent Document 3).

There is furthermore disclosed a belt fixing device wherein a curved portion having large curvature is formed between a nip portion and a pressure contact portion of an auxiliary roller when the auxiliary roller having a small diameter comes in pressure contact with a fixing roller through a fixing belt at an exit side of the nip portion, whereby, recording paper having passed through the nip portion is separated from the fixing belt at the curved portion (see Patent Document 4).

(Patent Document 1) Unexamined Japanese Patent Application Publication No. 2003-5566

(Patent Document 2) Unexamined Japanese Patent Application Publication No. 2003-122172

(Patent Document 3) Unexamined Japanese Patent Application Publication No. 2003-330309

(Patent Document 4) Unexamined Japanese Patent Application Publication No. 2003-330310

However, technologies of Patent Documents mentioned above have the following problems.

In the Patent Document 1, a fixing belt is trained about a heat roller, a fixing roller and a fixed member having a small radius of curvature, and the fixed member is in pressure contact with a pressure roller through the fixing belt from the inside of the fixing belt. Therefore, the reverse side of the fixing belt is rubbed constantly by the fixed member that has a small radius and does not rotate, which results in a problem that the fixing belt tends to be worn away, and sufficient durability cannot be expected.

In the Patent Document 2, there is a problem that an image that has been fixed tends to be scratched by a claw provided on a separation rotor.

In the Patent Document 3, there is a problem that an image that has been fixed tends to be scratched by an edge of a separation member.

In the Patent Document 4, there is a problem that an uneven gloss tends to be generated because close adhesion between a toner image on recording paper and a fixing belt is unstable and irregular, on the downstream side of the nip portion.

SUMMARY OF THE INVENTION

The invention has been achieved in view of the problems stated above, and its object is to provide an image forming apparatus equipped with a belt fixing device in which recording sheet that passes through is separated surely even when it is a thin sheet, in a simple structure.

The object stated above can be attained by the following items of embodiments.

Item 1:

An image forming apparatus comprising: an image forming section to form a toner image on a recording sheet;

a fixing device comprising: a fixing roller; an endless fixing belt trained with a tension about at least two rollers including the fixing roller; a heating device to heat the endless fixing belt; and a pressure roller to press the fixing roller through the endless belt, wherein the fixing device fixes the toner image on the recording sheet at a nip portion formed between the heated endless fixing belt and the pressure roller, a tension changing section to change the tension of the endless fixing belt;

a recording sheet discriminating section to discriminate a type of recording sheet to be used; and a controller controling to make the tension changing section to change the tension of the fixing belt corresponding to the type of recording sheet discriminated by the recording sheet discriminating section.

Item 2:

An image forming apparatus comprising:

an image forming section to form a toner image on a recording sheet;

a fixing device comprising: a fixing roller; an endless fixing belt trained with a tension about at least two rollers including the fixing roller; a heating member to heat the endless fixing belt; and a pressure roller to press the fixing roller through the endless belt, wherein the fixing device fixes the toner image on the recording sheet at a nip portion formed between the heated endless fixing belt and the pressure roller;

a tension changing section to change the tension of the endless fixing belt;

a separation priority mode setting section, and a controller controling to make the tension changing section operate to reduce the tension of the endless fixing belt, when the separation priority mode is set by the separation priority mode setting section.

DETAILED DESCRIPTION OF THE PREFERRED EMBODIMENT

Figure 1:
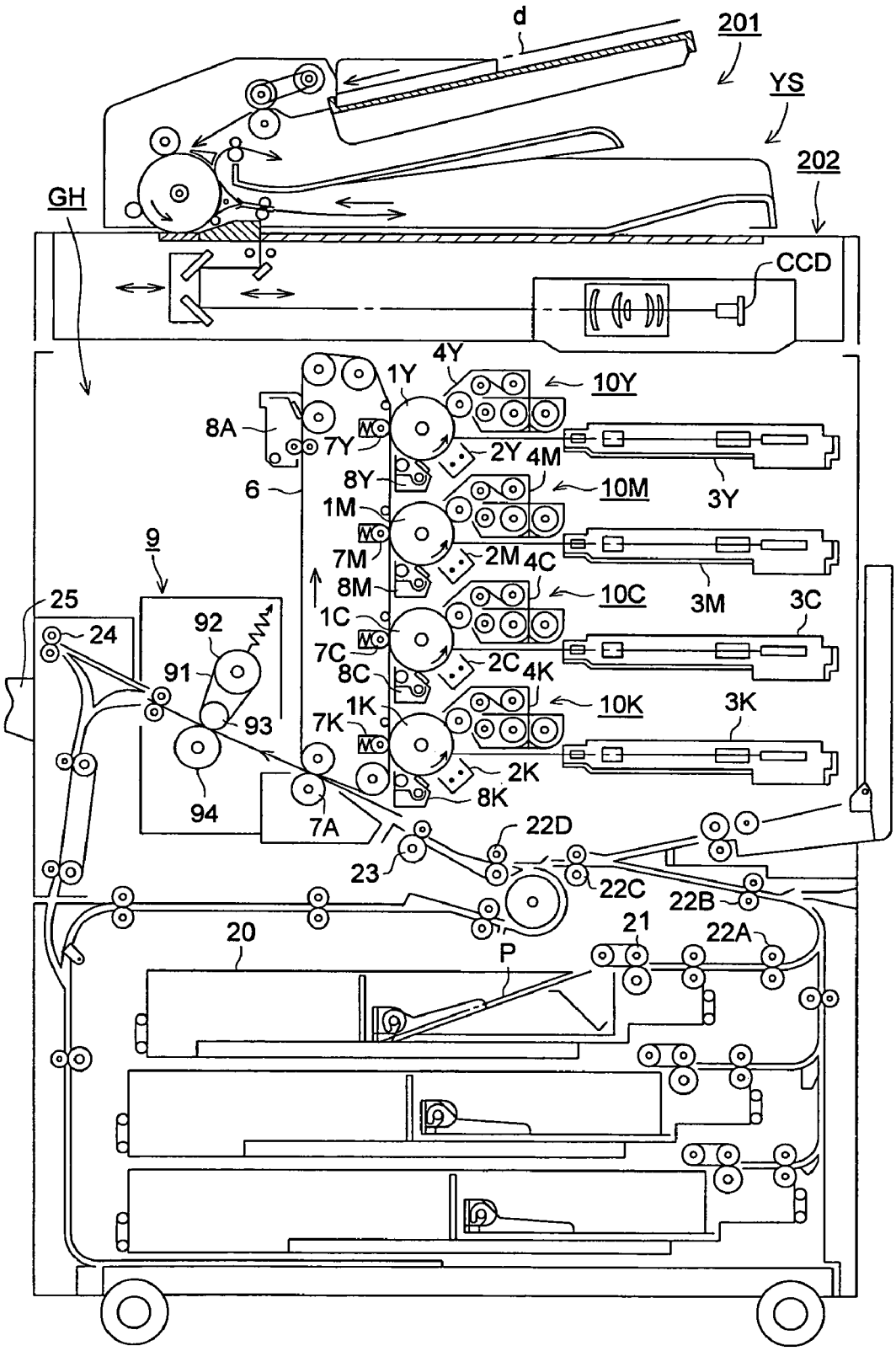
FIG. 1 is a structural diagram of an image forming apparatus.

An embodiment relating to the image forming apparatus of the invention will be explained as follows, referring to the drawings.

First, an example of an image forming apparatus will be explained based on the structural diagram in FIG. 1.

The image forming apparatus comprises an image forming apparatus main body GH and an image reading apparatus YS.

The image forming apparatus main body GH is one called a tandem type color image forming apparatus, and it comprises plural sets of image forming sections 10Y, 10M, 10C and 10K, and of belt-shaped intermediate transfer member 6, a paper-feeding conveyance device and fixing device 9.

On the image forming apparatus main body GH, there is provided image reading apparatus YS that is composed of automatic document feeder 201 and document image scanning exposure device 202. Document d placed on a document table of the automatic document feeder 201 is conveyed by a conveyance device, then, images on one side or both sides of the document are scanned and exposed by an optical system of the document image scanning exposure device 202 to be read by line image sensor CCD.

Signals formed after being converted photoelectrically by line image sensor CCD are subjected to analog processing, A/D conversion, shading correction and image compression processing, and then, are sent to exposure devices 3Y, 3M, 3*c* and 3K.

Around photoconductor drum 1Y in image forming section 10Y that forms a yellow (Y) color image, there are arranged charging device 2Y, exposure device 3Y, developing unit 4Y and cleaning device 8Y. Around photoconductor drum 1M in image forming section 10M that forms a magenta (M) color image, there are arranged charging device 2M, exposure device 3M, developing unit 4M and cleaning device 8M. Around photoconductor drum 1C in image forming section 10C that forms a cyan (C) color image, there are arranged charging device 2C, exposure device 3C, developing unit 4C and cleaning device 8C. Around photoconductor drum 1K in image forming section 10K that forms a black (K) color image, there are arranged charging device 2K, exposure device 3K, developing unit 4K and cleaning device 8K. Each of a combination of charging device 2Y and exposure device 3Y, a combination of charging device 2M and exposure device 3M, a combination of charging device 2C and exposure device 3C and a combination of charging device 2K and exposure device 3K constitutes a latent image forming section.

Incidentally, two-component developer composed of small particle toner and carrier in each color of yellow (Y), magenta (M), cyan (C) and black (K) is involved in each of developing units 4Y, 4M, 4C and 4K.

The intermediate transfer member 6 is trained about plural rollers to be supported rotatably.

In the fixing device 9, endless fixing belt 91 is trained about heat roller 92 and fixing roller 93, and the fixing device 9 has pressure roller 94 that presses the fixing roller 93 through the fixing belt 91, thus, a toner image on recording paper (transfer material) P is heated and pressed to be fixed at a nip portion formed between the fixing belt 91 and the pressure roller 94.

In this way, an image in each color formed by each of image forming sections 10Y, 10M, 10C and 10K is transferred onto the rotating intermediate transfer member 6 by each of transfer devices 7Y, 7M, 7C and 7K (primary transfer), whereby, a color-image-composed toner image is formed. Recording paper P loaded in paper feeding cassette 20 is fed out by paper feeding device 21 to be conveyed to the transfer device 7A through paper feeding rollers 22A, 22B, 22C, 22D and registration roller 23, and a color image is transferred onto the recording paper P in the transfer device 7A (secondary transfer). The recording paper P on which the color image has been transferred is heated and pressed in fixing device 9, thereby, a color toner image is fixed. After that, the recording paper P is interposed between paper ejection rollers 24 to be ejected on paper ejection tray 25 located outside an apparatus.

On the other hand, after the color image is transferred onto the recording paper P by the transfer device 7A, residual toner on the intermediate transfer member 6 from which the recording paper P has been separated by means of the curvature is removed by cleaning device 8A.

Though what has been explained above is an image forming apparatus that forms a color image, an image forming apparatus may also be one that forms a monochromatic image.

Figure 2:
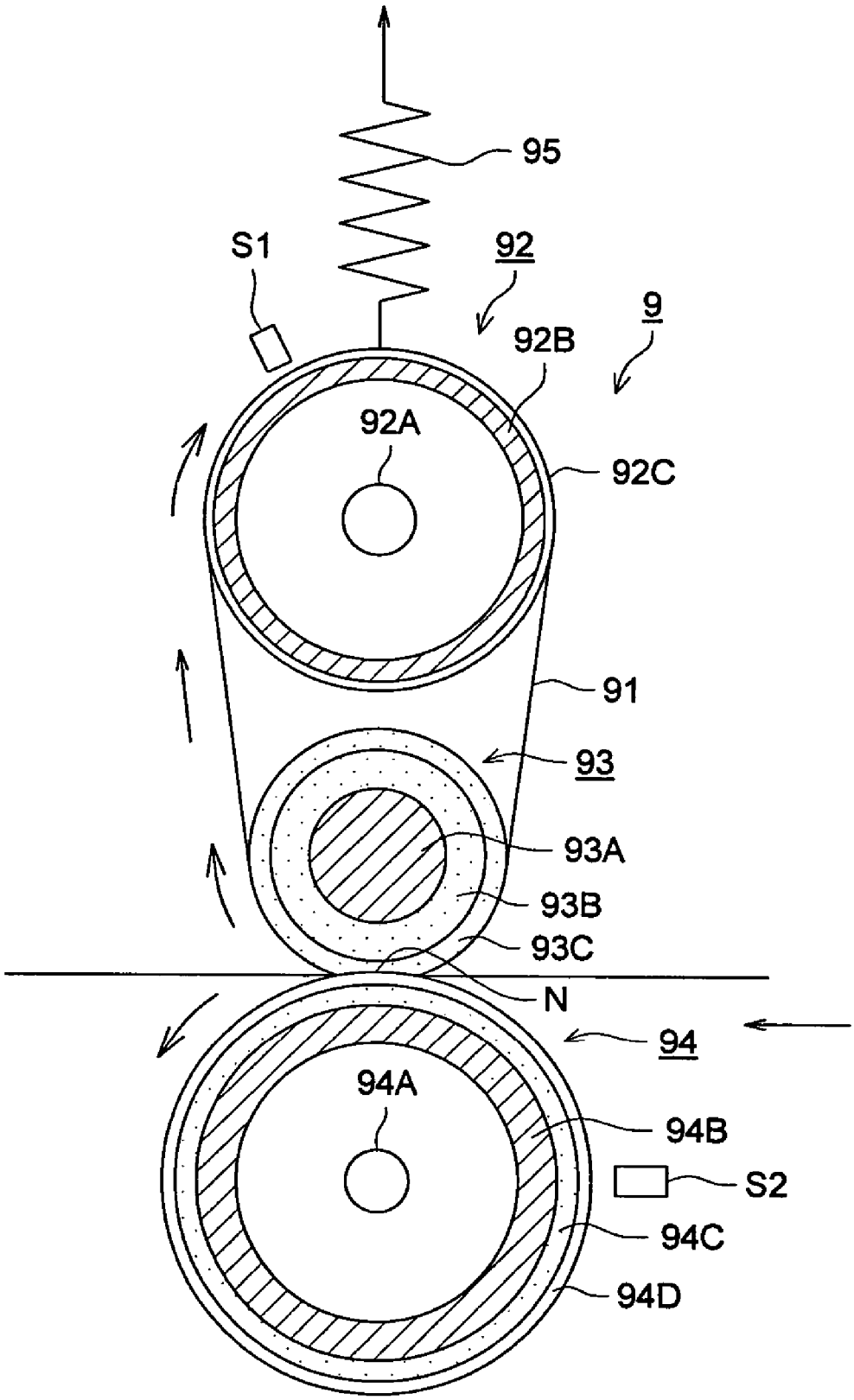
FIG. 2 is a cross-sectional view of a fixing device.

Next, a fixing device relating to the invention will be explained as follows, referring to the cross-sectional view in FIG. 2.

Fixing belt 91 is formed to be endless, and a heat-resistant resin belt that is made of a 70 μm-thick PI (polyimide), for example, is used as a substratum of the fixing belt 91, an outer circumferential surface of the substratum is covered by 200 μm-thick heat-resistant silicon rubber, and it is further covered by a 30 μm-thick PFA (perfluoroalkoxy) tube as a releasing layer. Incidentally, a dimension of the outside diameter is 80 mm, for example, and its width is 340 mm, for example.

Heat roller 92 houses therein halogen lamp 92A representing a heating member that heats the fixing belt 91, ant it is constructed as a hard roller wherein an outer circumferential surface of cylindrical hollow rotator body 92B which is made of aluminum, for example, and has a wall thickness of 2 mm is covered by heat-resistant PFA tube 92C. Incidentally, a dimension of the outside diameter is 47 mm, for example.

Fixing roller 93 is constructed as a soft roller wherein solid mandrel 93A made of metal such as iron, for example, is covered by 4.5 mm-thick and heat-resistant silicon-rubber 93B, and is further covered by 2.5 mm-thick sponge 93C. A dimension of the outside diameter is 40 mm.

Pressure roller 94 houses therein halogen lamp 94A, and it is constructed as a soft roller wherein an outer circumferential surface of cylindrical hollow rotator body 94B which is made of aluminum, for example, and has a wall thickness of 3 mm is covered by 3 mm-thick heat-resistant silicon rubber 94C and it is further covered by 30 μm-thick PFA (perfluoroalkoxy) tube 94D as a releasing layer. Incidentally, a dimension of the outside diameter is 50 mm, for example.

Meanwhile, as a heating member to heat the fixing belt 91, any types of heating members can be used, and for example, an induction heating heater element employing an exciting coil can be used. Further, a heating member does not always need to be arranged in the heat roller 92 or the like, and it can be arranged anywhere.

An unillustrated supporting shaft for the heat roller 92 can be moved vertically, and it is urged upward by tension spring 95 which is hooked on the heat roller 92. Therefore, if the urging force of the tension spring 95 is changed, tension of the fixing belt 91 is changed.

In this case, a solenoid or a motor can be used as a driving source to change the urging force of the tension spring 95.

Although the tension of the fixing belt 91 can be changed by providing a tension roller, it is not preferable because the structure is made to be complicated and heat is absorbed by the tension roller.

There are further provided temperature sensor S1 that detects temperatures of the heat roller 92 through the fixing belt 91, and temperature sensor S2 that detects temperatures of the pressure roller 94.

When fixing roller 93 is rotated clockwise by an unillustrated driving device in the structure stated above, both the fixing belt 91 and the heat roller 92 rotate clockwise, and the pressure roller 94 rotates counterclockwise. Further, the fixing belt 91 that comes in contact with the heat roller 92 is heated by halogen lamp 92A, and the pressure roller 94 is also heated by halogen lamp 94A. Then, since the pressure roller 94 is urged by an unillustrated urging device toward the fixing roller 93, recording paper P thus fed is heated and pressed in nip portion N between the fixing belt 91 trained about the fixing roller 93 and the pressure roller 94, whereby, a toner image on the recording paper P is fixed.

Next, there will be described experiments conducted by using an image forming apparatus equipped with the aforesaid fixing device and by changing tension of the fixing belt.

Contents of Experiments:

Four types of recording paper were made to run through the image forming apparatus to confirm separation properties and fixing properties, while changing tension of the fixing belt and by changing temperatures of the fixing belt.

Controlled temperature: The temperature of the pressure roller was established to be lower than that of the fixing belt by 20° C.

Paper running speed: 300 mm/s

Amount of adhesion of toner: 10±0.3 g/m$^2$

Recording paper:

Plain paper X Weight of 56 g/m$^2$

Plain paper Y Weight of 80 g/m$^2$

Coated paper X Weight of 80 g/m$^2$

Coated paper Y Weight of 100 g/m$^2$

Results of Experiments:

Data of separation properties are shown in Tables 1(a)-1(e) and data of fixing properties are shown in Tables 2(a)-2(e).

TABLE 1 (a)

| Fixing belt tension: 8 N | | Heat roller temperature | | | | | | |
|---|---|---|---|---|---|---|---|---|
| Recording paper | | 150 | 160 | 170 | 180 | 190 | 200 | 210 |
| Plain paper | X | C | C | C | C | A | A | |
| | Y | | | C | C | C | C | |
| Coated paper | X | | | C | C | C | C | |
| | Y | | | C | C | C | C-B | B |

TABLE 1 (b)

| Fixing belt tension: 15 N | | Heat roller temperature | | | | | | |
|---|---|---|---|---|---|---|---|---|
| Recording paper | | 150 | 160 | 170 | 180 | 190 | 200 | 210 |
| Plain paper | X | A | A | A | A | A | A | |
| | Y | | | A | A | A | A | |
| Coated paper | X | | | A | A | A | A | |
| | Y | | | A | A | A | A | A |

TABLE 1 (c)

| Fixing belt tension: 20 N | | Heat roller temperature | | | | | | |
|---|---|---|---|---|---|---|---|---|
| Recording paper | | 150 | 160 | 170 | 180 | 190 | 200 | 210 |
| Plain paper | X | A | A | C | C | A | A | |
| | Y | | | A | A | A | A | |
| Coated paper | X | | | A | C | A | A | |
| | Y | | | A | A | A | A | A |

TABLE 1 (d)

| Fixing belt tension: 33 N | | Heat roller temperature | | | | | | |
|---|---|---|---|---|---|---|---|---|
| Recording paper | | 150 | 160 | 170 | 180 | 190 | 200 | 210 |
| Plain paper | X | A | C | C | C | A | A | |
| | Y | | | A | A | A | A | |
| Coated paper | X | | | A | C | C | A | |
| | Y | | | A | A | A | A | A |

TABLE 1 (e)

| Fixing belt tension: 46 N | | Heat roller temperature | | | | | | |
|---|---|---|---|---|---|---|---|---|
| Recording paper | | 150 | 160 | 170 | 180 | 190 | 200 | 210 |
| Plain paper | X | C | C | C | C | A | A | |
| | Y | | | A | C | C | A | |
| Coated paper | X | | | C | C | C | A | |
| | Y | | | A | A | C | A | A |

TABLE 2 (a)

| Fixing belt tension: 8 N | | Heat roller temperature | | | | | | |
|---|---|---|---|---|---|---|---|---|
| Recording paper | | 150 | 160 | 170 | 180 | 190 | 200 | 210 |
| Plain paper | X | C | A | A | A | A | A | |
| | Y | | | C | C | A | A | |
| Coated paper | X | | | C | A | A | A | |
| | Y | | | C | C | C | A | A |

TABLE 2 (b)

| Fixing belt tension: 15 N | | Heat roller temperature | | | | | | |
|---|---|---|---|---|---|---|---|---|
| Recording paper | | 150 | 160 | 170 | 180 | 190 | 200 | 210 |
| Plain paper | X | A | A | A | A | A | A | |
| | Y | | | C | C | A | A | |
| Coated paper | X | | | A | A | A | A | |
| | Y | | | C | C | C | A | A |

TABLE 2 (c)

| Fixing belt tension: 20 N | | Heat roller temperature | | | | | | |
|---|---|---|---|---|---|---|---|---|
| Recording paper | | 150 | 160 | 170 | 180 | 190 | 200 | 210 |
| Plain paper | X | A | A | A | A | A | A | |
| | Y | | | C | A | A | A | |
| Coated paper | X | | | A | A | A | A | |
| | Y | | | C | C | A | A | A |

TABLE 2 (d)

| Fixing belt tension: 33 N | | Heat roller temperature | | | | | | |
|---|---|---|---|---|---|---|---|---|
| Recording paper | | 150 | 160 | 170 | 180 | 190 | 200 | 210 |
| Plain paper | X | A | A | A | A | A | A | |
| | Y | | | A | A | A | A | |
| Coated paper | X | | | A | A | A | A | |
| | Y | | | A | A | A | A | A |

TABLE 2 (e)

| Fixing belt tension: 46 N | | Heat roller temperature | | | | | | |
|---|---|---|---|---|---|---|---|---|
| Recording paper | | 150 | 160 | 170 | 180 | 190 | 200 | 210 |
| Plain paper | X | A | A | A | A | A | A | |
| | Y | | | A | A | A | A | |
| Coated paper | X | | | A | A | A | A | |
| | Y | | | A | A | A | A | A |

Incidentally, the separation properties were evaluated as follows.

A: A recording paper was separated.

B: A recording paper was separated while showing its tendency of winding round a fixing roller.

C-B: A recording paper was separated somehow or other, while showing its considerable tendency of winding round a fixing roller.

C: A recording paper was not separated.

On the other hand, the fixing properties were evaluated as follows.

After fixing images having prescribed patterns, the images were rubbed by a cloth to measure density changes, and the fixing properties were evaluated as follows by the remaining density after rubbing.

A: the remaining density is prescribed density or more, which that fixing properties are excellent.

C: the remaining density is less than the prescribed density, which means that fixing properties are inferior.

Considerations:

First, with respect to separation properties shown in Table 1, there is a tendency that the separation properties tend to be improved when tension of the fixing belt is lowered, and when the tension is set to 15 N in the present experiments, all sheets of recording paper were separated even when temperatures of the heat roller were changed. However, when the tension was set to 8 N by lowering further the tension of the fixing belt, most sheets of recording paper were not separated.

The reason of the foregoing is estimated to be as follows; when the tension of the fixing belt is lowered, the pressure roller cuts more deeply into the fixing roller through the fixing belt, thus, a width of the nip is broadened to improve the separation properties. However, if the tension of the fixing belt is lowered excessively, the fixing belt has a tendency of being slackened at locations before and behind the nip portion, whereby, a curvature for separation in the vicinity of an exit side of a nip portion becomes small, which loweres the separation properties.

Further, in case of plain paper B and coated paper B both representing thick paper, all sheets were separated substantially even when temperatures of the heat roller were changed within a range of tensions 15N-33N. However, in case of plain paper A and coated paper A both representing thin paper, when temperatures of the heat roller were changed, all sheets were separated only for the tension of 15N.

When the tension was enhanced to 46N, separation properties were lowered for all types of paper.

On the other hand, with respect to fixing properties shown in Table 2, there is a tendency that the fixing properties tend to be worsened when tension of the fixing belt is lowered, and when the tension is set to 46N and 33 N in the present experiments, fixing properties for all sheets of recording paper were excellent even when temperatures of the heat roller were changed, however, when the tension was set to 20N or less, fixing properties were worsened gradually. This especially depends on paper quality, and for plain paper A and coated paper A both representing thin paper, even when the tension is lowered to 15N, fixing properties were not worsened, but for plain paper B and coated paper B both representing thick paper, when the tension is set to 20N, fixing troubles were caused when temperature of the heat roller was 180° C. or 170° C.

The reason for the foregoing is that the contact between the fixing belt and the heat roller becomes insufficient if the tension is set to be low, resulting in a reduction of heat supply to the fixing belt. In case of thick paper, in particular, heat supply to the fixing belt becomes further insufficient, and fixing troubles are caused. Compared with an occasion of thick paper, sufficient fixing temperature can be secured for thin paper, despite less amount of heat supply, which does not cause problems. From the viewpoint of fixing properties, therefore, the greater tension is preferable.

From the results mentioned above, it is understood that fixing of the tension is problematic for satisfying separation functions and fixing properties simultaneously.

Incidentally, a temperature of the heat roller is generally established at about 190° C., and when fluctuations of the established temperature and a temperature fall caused by paper threading immediately after a warm-up are taken into consideration, separation properties and fixing properties need to be assured within a range of 170° C.-200° C. for the heat roller temperature. Considering this point, Table 3 shows a result obtained by putting Table 1 and Table 2 together under the condition that A (in Table 3) represents an occasion where all sheets of paper showed A (in Table 2 and Table 3) within a range of 170° C.-200° C. for the heat roller temperature, and C represents an occasion where at least one sheet of paper showed C. Further, a column on the right side of Table 3 shows overall results for separation properties and fixing properties.

TABLE 3

| Fixing belt tension | Recording paper | | Separation properties | Fixing properties | Overall Results |
|---|---|---|---|---|---|
| 8 N | Plain | X | C | A | |
| | paper | Y | C | C | |
| | Coated | X | C | C | |
| | paper | Y | C | C | |
| 15 N | Plain | X | A | A | Good |
| | paper | Y | A | C | |
| | Coated | X | A | A | Good |
| | paper | Y | A | C | |
| 20 N | Plain | X | C | A | |
| | paper | Y | A | C | |
| | Coated | X | C | A | |
| | paper | Y | A | C | |
| 33 N | Plain | X | C | A | |
| | paper | Y | A | A | Good |
| | Coated | X | C | A | |
| | paper | Y | A | A | Good |
| 46 N | Plain | X | C | A | |
| | paper | Y | C | A | |
| | Coated | X | C | A | |
| | paper | Y | C | A | |

Table 3 shows that both of separation properties and fixing properties become excellent if the fixing belt tension is set to 33N for thick paper and to 15N for thin paper, independently of plain paper and coated paper.

As stated above, it is possible to improve separation properties without worsening fixing properties of recording paper, by varying the fixing belt tension corresponding to a recording paper thickness, and a value of the aforesaid fixing belt tension is not an absolute value, and it varies depending on dimensions and materials of respective members of the fixing device.

Further, in the case where toner images are formed on an entire surface of a recording paper, including, for example, an occasion of photographs or materials for presentation, separation properties are lowered even when each of them is thick paper. Therefore, when feeding a recording paper that is hardly separated, it is preferable to provide in an image forming apparatus a separation priority mode that sets the fixing belt tension to 20N, although fixing properties are lowered.

Figure 3:
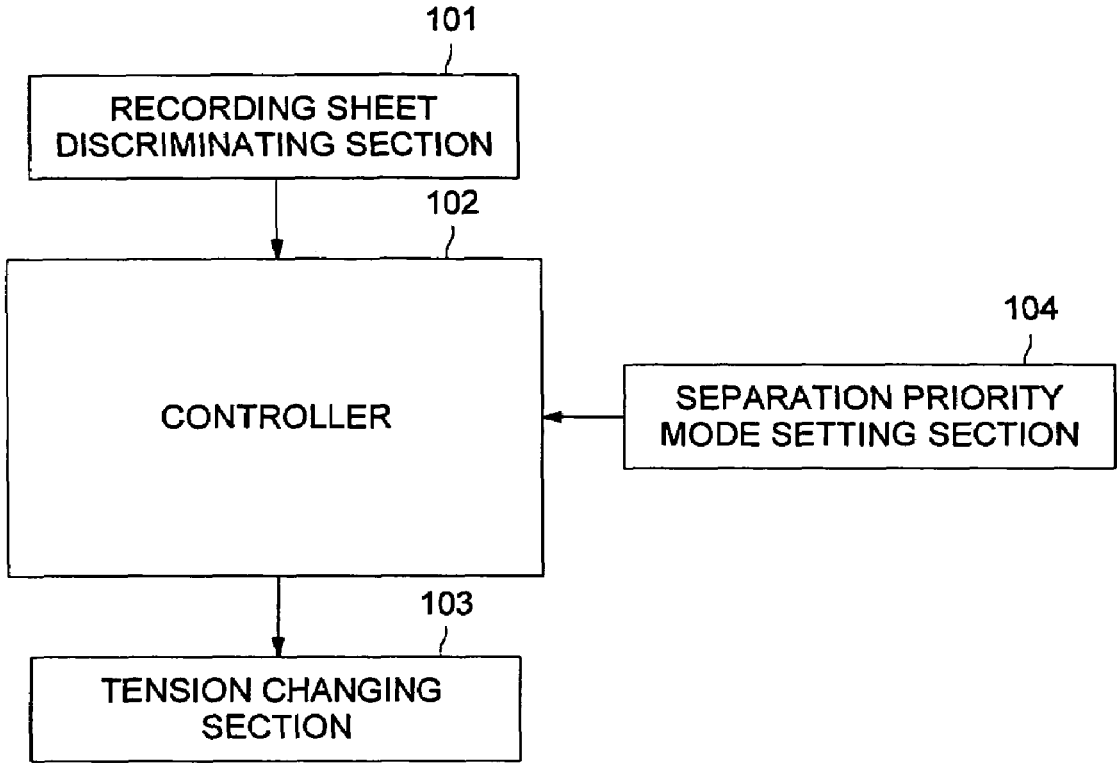
FIG. 3 is a block diagram relating to the invention.

FIG. 3 shows, as a block diagram, the structure to change the fixing belt tension in accordance with types of recording paper to be fed in a belt fixing device.

In FIG. 3, recording sheet discriminating section 101 is a section that discriminates types of recording paper to be fed, and it discriminates whether the recording paper is plain paper or coated paper, and it discriminates weight of the recording paper. Specifically, a recording paper to be used by a user is selected on an operation board to be inputted. Further, it is preferable to arrange, in an image forming apparatus, a sensor that measures reflectance, a thickness and specific gravity of a recording paper, to discriminate automatically the type of the recording paper.

Information outputted from recording sheet discriminating section 101 is inputted in controller 102 which operates tension changing section 103 in accordance with a type and weight of the recording paper. To be concrete, the information about a type and weight of the recording paper thus inputted are compared with prescribed conditions and the recording paper is discriminated whether it corresponds to a thin paper or not. When the recording paper is discriminated not to be a thin paper, the tension is set, for example, to 33N, while when discriminated to be a thin paper, the tension is lowered and is set, for example, to 15N. Meanwhile, the tension changing section 103 is a section to change the fixing belt tension in accordance with the established tension, and a solenoid or a motor can be used as the tension changing section 103.

When outputting an image pattern that is hardly separated, if a user sets a separation priority mode by operating separation priority mode setting section 104 on an operation board, controller 102 drives tension changing section 103 to lower the tension of the fixing belt to the predetermined tension.

In the embodiment stated above, even when a recording paper such as a thin sheet of paper is fed in an apparatus, the recording paper can surely be separated after passing through the fixing device, because the tension of the fixing belt of the belt fixing device is changed in accordance with a recording paper to be fed.

In the embodiment stated above, even when a hard-to-separate recording paper, having an image pattern such as a photographic image with a large amount of toner, is fed in an apparatus, the recording paper can surely be separated after passing through the fixing device, because the tension of the fixing belt of the belt fixing device is changed in accordance with selection of the separation priority mode.

What is claimed is:

1. An image forming apparatus comprising:

an image forming section to form a toner image on a recording sheet;

a fixing device comprising: a fixing roller; a heat roller; an endless fixing belt trained with a tension about at least two rollers including the fixing roller and the heat roller; a heating device to heat the endless fixing belt; and a pressure roller to press and deform the fixing roller through the endless belt, wherein the fixing device fixes the toner image on the recording sheet at a nip portion formed between the heated endless fixing belt and the pressure roller, and wherein the pressure roller is arranged at an opposite side from the heat roller with respect to the fixing roller;

a tension changing section, which moves a position of the heat roller to change the tension of the endless fixing belt;

a recording sheet discriminating section to discriminate a type of recording sheet to be used; and a controller controlling to make the tension changing section to change the tension of the fixing belt corresponding to the type of recording sheet discriminated by the recording sheet discriminating section.

2. The image forming apparatus of claim 1, wherein when the recording sheet is discriminated to be a thin paper type, the controller controls to reduce the tension of the fixing belt.

3. An image forming apparatus comprising:

an image forming section to form a toner image on a recording sheet;

a fixing device comprising: a fixing roller; a heat roller; an endless fixing belt trained with a tension about at least two rollers including the fixing roller and the heat roller; a heating device to heat the endless fixing belt; and a pressure roller to press and deform the fixing roller through the endless belt, wherein the fixing device fixes the toner image on the recording sheet at a nip portion formed between the heated endless fixing belt and the pressure roller, and wherein the pressure roller is arranged at an opposite side from the heat roller with respect to the fixing roller;

a tension changing section, which moves a position of the heat roller to change the tension of the endless fixing belt; a separation priority mode setting section; and a controller controlling to make the tension changing section operate to reduce the tension of the endless fixing belt, when the separation priority mode is set by the separation priority mode setting section.

* * * * *